United States Patent [19]

Haller

[11] Patent Number: 4,583,154

[45] Date of Patent: Apr. 15, 1986

[54] PORTABLE LAMP WITH A FLUORESCENT TUBE AND A BALLAST TUBE

[75] Inventor: Erich Haller, Zurich, Switzerland

[73] Assignee: Florida Specialty Parts, Inc., Pompano Beach, Fla.

[21] Appl. No.: 703,175

[22] Filed: Feb. 19, 1985

[30] Foreign Application Priority Data

Apr. 6, 1984 [CH] Switzerland ..... 1754/84

[51] Int. Cl.[4] ..... F21S 3/00

[52] U.S. Cl. ..... 362/222; 362/376

[58] Field of Search ..... 362/217, 222, 221, 186, 362/223, 376

[56] References Cited

U.S. PATENT DOCUMENTS

| | | | |
|---|---|---|---|
| 2,347,174 | 4/1944 | Cross et al. | 362/222 |
| 2,798,149 | 7/1957 | Bodez | 362/222 |
| 3,154,252 | 10/1964 | Baake | 362/222 |
| 4,156,893 | 5/1979 | Baake | 362/222 |
| 4,345,305 | 8/1982 | Kolm et al. | 362/222 |
| 4,352,539 | 10/1982 | Vest | 362/221 |

FOREIGN PATENT DOCUMENTS

| | | | |
|---|---|---|---|
| 234839 | 8/1961 | Australia | 362/222 |

*Primary Examiner*—E. Rollins Cross

*Attorney, Agent, or Firm*—Browdy and Neimark

[57] ABSTRACT

A fluorescent tube (10) supported at both ends in a respective base (15, 16) is surrounded by a transparent guard tube (1), which is closed at one end by cap (2) having suspension hooks (3) and at the other by a handle (5) having a connection cable (7). A circuit board (24) having an ignition and feeder circuit arrangement is mechanically releasably connected with both the base (16 ) on the end toward the handle and with a closure element (28) disposed in the end area of the guard tube (1) toward the handle, this releasable connection being effected by holding devices (22, 26; 29). The closure element (28) is latched into the guard tube (1) by means of a detent spring (30). Contact pins (13, 14) and the connection cable (7) are connected to the circuit board (24) in a plug-insertable manner. The fluorescent tube (10) together with its bases (15, 16) and the associated circuit board (24) with the closure element (28) accordingly embody a mechanically coherent structural unit, which is easily pulled out of the guard tube (1) in order to change the fluorescent tube (10). No tool is required to accomplish this. Furthermore, to accommodate fluorescent tubes (10) of various types or dimensions, only the length of the guard tube (1) and the components inserted into the circuit board (24) need be adapted.

13 Claims, 10 Drawing Figures

PORTABLE LAMP WITH A FLUORESCENT TUBE AND A BALLAST TUBE

FIELD OF THE INVENTION

The present invention relates to a portable lamp having a fluorescent tube and a ballast tube. The fluorescent tube is surrounded by an at least partly transparent guard tube, which is closed at one end with a cap and at the other end with a handle that is embodied to receive a power connection cable. The fluorescent tube is seated in a base at each end, and a carrier plate or circuit board having an arrangement of ignition and feeder circuits is associated with the base on the end toward the handle. The carrier plate or circuit board is electriclaly connected to connection elements of the fluorescent tube on both ends as well as to the connection cable.

BACKGROUND OF THE INVENTION

Portable lamps of this generic type are known in various forms, for instance from Swiss Pat. Nos. 349'701 and 586'871 and from French Patent Application No. 73 25180 (Publication No. 2 237 121). The known portable lamps have the primary disadvantage that they are made up of individual components or groups of components that are individually matched to one another and can be disassembled only by the use of tools, and that removal and replacement of the fluorescent tube is relatively complicated and tedious.

SUMMARY OF THE INVENTION

It is the object of the present invention to devise a portable lamp of the above-described type, in which the components including the fluorescent tube are contained in the guard tube and comprise a compact unit, which is quickly, easily and practically removed from the guard tube without using tools so that the fluorescent tube can be replaced, and in which the components, including the guard tube, have dimensions or electrical properties which are dependent on the type of fluroescent tube used and are interchangeable without requiring alteration.

In order to attain this object, the portable lamp according to the invention has a carrier plate or circuit board connected in a mechanically releasable manner to the base on the end nearer the handle and to a closure element disposed in the vicinity of the end of the guard tube nearer the handle, and the closure element is provided with means with which it can be locked into the guard tube.

The invention therefore comprises as a structural unit, a fluorescent tube with its two bases and a carrier plate or circuit board of the ballast tube with its closure element. In order to assemble the portable lamp, this unit can be inserted in a simple manner into the guard tube, which is provided with an end cap, and locked into place there; the handle is then pushed into place on the guard tube. To replace the fluorescent tube, the procedure is equally simply performed in reverse order, by removing the handle from the guard tube, unlatching the closure element of the carrier plate or circuit board from the guard tube and removing the structural unit from the guard tube.

An additional advantage is that only two components, embodied appropriately, need to be provided for fluorescent tubes of various lengths and electrical specifications, or for various supply voltages. These two components are a carrier plate or circuit board with the appropriate ballast tube for the particular type of fluorescent tube used or for the planned supply voltage and a guard tube having the proper length for the particular type of fluorescent tube used and if needed the carrier plate or circuit board associated with it.

Exemplary embodiments of the subject of the invention are described in detail below, in conjunction with the drawings.

DESCRIPTION OF THE PREFERRED EMBODIMENTS

Figures 1, 2, 3, 4, 5, 6, 7:
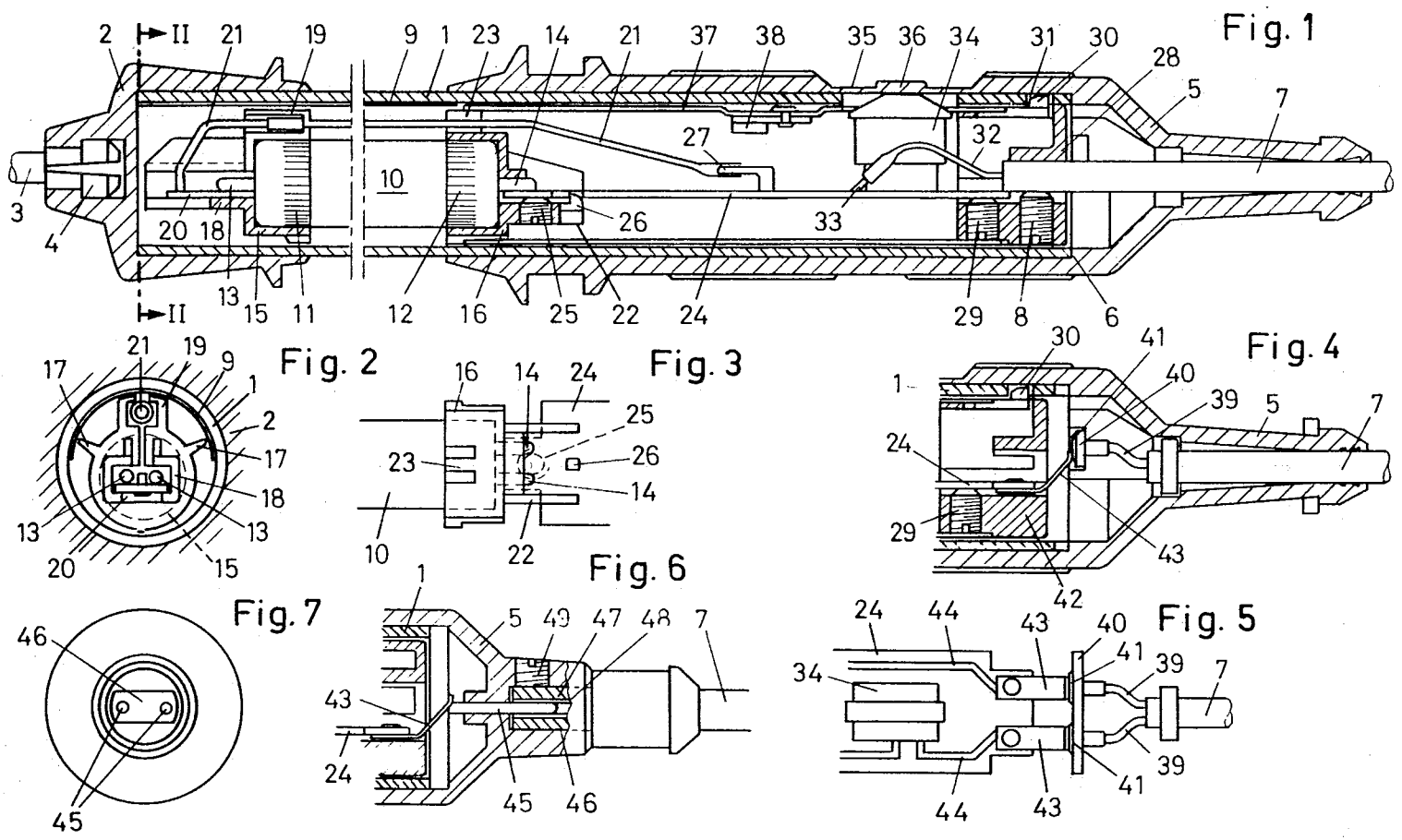
FIG. 1 is a longitudinal section taken through a portable lamp according to the invention.
FIG. 2 is a section taken along the line II—II in FIG. 1.
FIG. 3 is a plan view on the base nearer the handle for the fluorescent tube.
FIG. 4 is a longitudinal section through a portion of the closure element of the carrier plate, with the connection cable jointed to it, in a variant of the embodiment of FIG. 1.
FIG. 5 is a plan view on the apparatus of FIG. 4 for joining the connection cable to the carrier plate.
FIG. 6 is a longitudinal section through a portion of the closure element of the carrier plate with the plugin-sertable connection cable joined to it, in a further variant of the embodiment of FIG. 1.
FIG. 7 is a plan view on the end of the handle according to FIG. 6, with the connection cable removed.

As shown in FIG. 1, the present portable lamp has a guard tube 1, which is made of a transparent material such as a transparent plastic. The guard tube 1 is closed on its outer end by a cap 2, which is preferably made of an elastic plastic material. A suspension hook 3, shown only in part, is disposed in the end cap 2 by means of a spreading holder 4. A handle 5, preferably also of an elastic plastic material, is pushed onto the other end of the guard tube 1, resting on its interior on the guard tube 1 by means of a step 6. A connection cable 7 is passed through an axial opening in the handle 5 and is secured against strain by a screw 8 to be described in further detail below. Between the end cap 2 and the handle 5, the inside of the guard tube 1 is provided with a reflective lining 9, which extends over a predetermined region, for instance half, of the circumference of the guard tube 1 and by way of example is a metal foil or paper foil.

A fluorescent tube 10 is disposed in the interior of the guard tube 1, having end caps 11 and 12 and contact pins 13 and 14, respectively, at each end in a known manner. The fluorescent tube 10 is inserted at both ends into respective sheath-like bases 15 and 16, which surround the respective end caps 11, 12 of the fluorescent tube 10 and have openings for the respective contact pins 13, 14 of the fluorescent tube 10.

The base 15 adjacent the end cap 2 of the guard tube 1 is supported via protrusions 17 (see FIG. 2) on the inside surface of the guard tube 1 and is provided with both a box-like extension 18 and an extension 19 which has a stepped bore. A contact lamina 20 is embedded in the box-like extension 18, and the contact pins 13 of the fluorescent tube 10 rest on this contact lamina 20 and are therefore in electrical contact with it. A conductor 21 is also firmly joined to the contact lamina 20, for instance by soldering or riveting. The conductor 21 may be a stranded wire or a resistor wire and is passed through the stepped bore of the extension 19, in which it is mechanically retained, along the reflective lining 9 in the direction toward the handle 5. Alternatively, instead of being joined to the conductor 21 via the contact lamina 20, the contact pins 13, or at least one of the two contact pins 13, may be joined to the conductor 21 via a plug element.

The other sheath-like base 16, which likewise rests on the inside surface of the guard tube 1, has a chute-like extension 22 (FIGS. 1, 3) as well as a clamping slit 23 for the conductor 21. The two contact pins 14 of the fluorescent tube 10 engage the interior of the chute-like extension 22, as does the tongue-like end of a circuit board 24 which is inserted into slits in the two side walls of the chut-like extension 22. The carrier plate or circuit board 24 is provided with a contact surface (not shown) on this tongue-like end, and the contact pins 14 of the fluorescent tube 10 rest on this contact surface; the contact pressure is adjustable by means of a screw 25 which is disposed in the bottom of the extension 22. A detent spring 26 is also molded onto the bottom of the extension 22, engaging an opening in the circuit board 24 and thereby effecting a mechanical connection between the circuit board 24 and the base 16. The circuit board 24 is furthermore connected electrically with the conductor 21 via a plug device 27.

A sheath-like closure element 28 is disposed on the other end of the circuit board 24, resting on the inside surface of the guard tube 1. The closure element 28 has a slit into which the circuit board 24 is introduced and in which the circuit board is held firmly by a screw 29, so that the circuit board 24 and the closure element 28 are mechanically connected to one another. The axial position of the closure element 28 relative to the guard tube 1 is defined by a detent spring 30 molded onto the closure element 28, the locking protrusion of the detent spring 30 being located in a corresponding opening 31 of the guard tube 1. The closure element 28 additionally has an axial bore, through which the cable 7 is retained in this bore by the strain-reflief screw 8 mentioned above, which is supported in the closure element 28. The conductors 32 of the cable 7 are likewise releasably connected electrically with the circuit board 24 via plug devices 33.

A push switch 34 is also disposed on the circuit board 24 and it is actuatable from the outside by exerting pressure upon the handle. To this end, in the area opposite the push switch 34, the handle 5 is embodied as a diaphragm 35 of circular-annular or rectangular-ring configuration with a raised central area 36, so that no opening in the wall of the handle 5 is required for actuating the push switch 34.

The ballast resistor required for operating the fluorescent tube 10 can likewise be disposed on the circuit board 24, in the case of low-power fluroescent tubes. For higher-power fluorescent tubes, it is more efficient to embody the conductor 21 leading to the contact pins 13 of the fluorescent tube 10 as a resistor wire, in a known manner, because the heat produced is better distributed and dissipated thereby. In order further to assure optimal dissipation of the heat generated by the components located on the circuit board 24, a cooling tube 37 is disposed on the sinside surface of the guard tube 1 in the vicinity of the circuit board 24, being retained by the base 16 and the closure element 28. A transistor 38 (or a plurality of transistors), which is provided in the case of weak current operation, may be mounted directly on the cooling tube 37.

In the portable lamp shown, the circuit board 24 is mechanically connected on the one hand, via the screw 29, to the closure element 28 which is locked into place in the guard tube 1, and on the other, via the detent spring 26, to the base 16. Additionally, the screw 25 exerts a sufficient clamping effect, which is nevertheless releasable by removing the screw, the clamp the fluorescent tube 10 to the base 16 and to the circuit board 24. Consequently the cable 7, the closure element 28, the circuit board 24, the base 16, the fluorescent tube 10 and the base 15 comprise a coherent structural unit, which can be removed from the guard tube 1 in the following simple manner, in order to open the portable lamp:

The handle 5 is removed from the guard tube 1 via the cable 7, an operation which is unhindered by the push switch 34.

The detent spring 30 is depressed and the closure element 28 is removed from the guard tube 1, together with the parts joined to the closure element 28, namely the circuit board 24, the base 16, the fluorescent tube 10 and the other base 15; during this removal operation, the push switch 34, because of its oblique surfaces, is depressed by the guard tube 1 in a resilient manner.

The plug device 27 between the circuit board 24 and the conductor 21 is unplugged.

The fluorescent tube 10 is removed from the bases 15 and 16.

The insertion of a new fluorescent tube 10 and the subsequent closure of the portable lamp is accomplished in the reverse order.

It is futhermore apparent that only one guard tube 1 of appropriate length needs to be provided as a special part in order to install various types of fluorescent tubes 10—that is, tubes 10 having various lengths. If the ignition and feeder circuit arrangement must be dimensioned or structured differently, depending on the type of fluorescent tube 10 used, an appropriately pre-assembled circuit board 24 can be inserted, simply by removing and reinserting the conductors 21 and 32 and by loosening and retightening the screws 25 and 29. Accordingly, the present portable lamp is standardized to such an extent that except for the guard tube 1 and possibly the components assembled on the circuit board 24, the same parts can be used for any length of fluorescent tube.

In FIGS. 4 and 5, a further embodiment of a closure element is shown, by means of which when the handle 5 is removed from the guard tube 1 an immediate electrical separation of the connection cable 7 from the tracks located on the circuit board 24 takes place automatically. As a result, even if the connection cable 7 is by oversight left connected to the mains current, the portable lamp can be opened without the danger of touching any elements carrying voltage.

An insulating plate 40 (FIG. 5) is disposed in the handle 5 near the opening for the connection cable 7 and carries two flat contact elements 41, with which the conductors 39 of the cable 7 are firmly connected. A closure element 42, which is otherwise embodied and disposed identically to the closure element 28 of FIG. 1, has instead of a bore for the connection cable 7 two contact springs 43, which are secured on the circuit board 24 that is secured with the screw 29 and are electrically connected with associated tracks 44 (FIG. 5) of the circuit board 24. The push switch 34 (FIG. 1) is connected in circuit with one track 44. As soon as the handle 5 is pulled off the guard tube 1 by a short distance, the contact springs 43 are lifted away from the contact elements 41, so that the circuit board 24 no longer carries voltage and can be removed without danger from the guard tube 1, together with the fluorescent tube, in the manner described above. Since the contact elements 41, which may possibly be carrying voltage, are located deep within the handle 5, it is practically impossible to touch them by mistake.

Instead of being anchored firmly in the handle 5 by means of strain relief and pressing devices, as shown in FIG. 4, the connection cable 7 can also be embodied as a plug-in element. This type of embodiment is shown in FIGS. 6 and 7, in which two contact pins 45 are disposed firmly in the handle 5, preferably being embedded in the material comprising the handle when the handle 5 is formed; these contact pins are open at both ends. Two contact springs 43 are again secured on the circuit board 24, resting on the inner open ends of the contact pins 45. The outer open ends of the contact pins 45 are located in a substantially rectangular indentation 46 embodied on the front end of the handle 5. The indentation 46 is provided in order to receive a correspondingly configured rectangular plug 47 molded onto the cable 7. The plug 47 has contact bushes 48 for the contact pins 45, and the bushes 48 are joined to the wires of the connection cable 7. A screw 49 supported in the handle 5 makes it possible to clamp the plug 47 firmly in the handle 5.

In this embodiment of the portable lamp, as in that shown in FIG. 4, an immediate separation of the electrical connection of the circuit board 24 with the connection cable 7, which is effected via the contact springs 43 and the contact pins 45, takes place when the portable lamp is opened, that is, when the handle 5 is removed from the guard tube 1. Additionally, the connection cable 7 can be separated from the handle 5 simply by being removed or pulled off from it; this is particularly advantageous if the portable lamp needs to be repaired or is to be altered to fit the fluorescent tube used and to provide the proper length of the guard tube 1 for that purpose.

Figure 9:
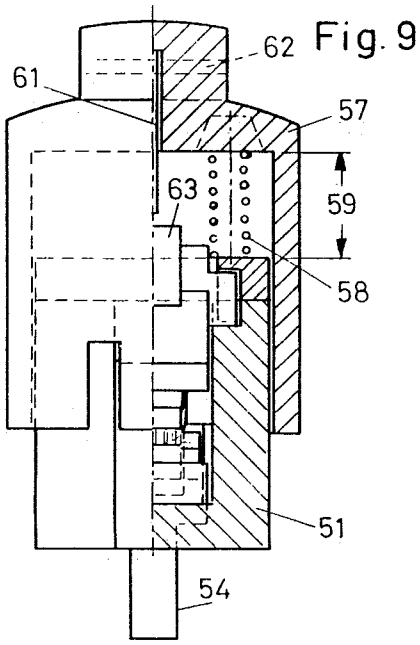
FIG. 9 is a side elevation of the push switch of FIG. 8.
Figure 8:
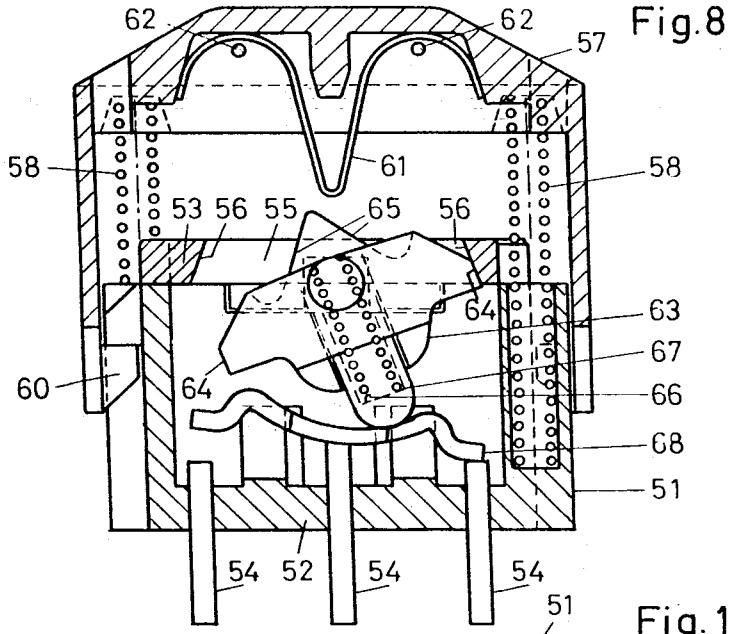
FIG. 8 is a vertical section of a push switch disposed in the portable lamp of FIG. 1.
Figure 10:
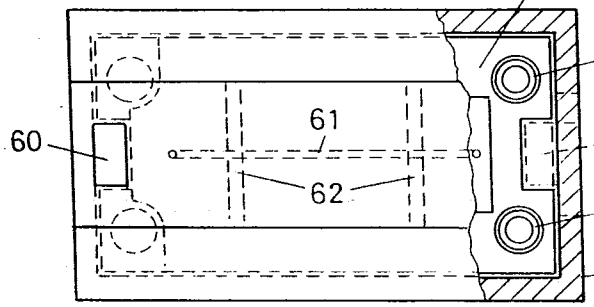
FIG. 10 is a plan view of the push switch of FIG. 8.

A further advantageous embodiment of the push switch 34 shown in FIG. 1 will now be described, referring to FIGS. 8–10. It should be noted, however, that the portable lamp according to the invention can also be used without a push switch or similar switching device.

The push switch shown, which is embodied as a selective switch, has a rectangular switch housing 51 with a housing bottom 52 and a housing cap 53. Three connection pins 54 for securing the switch on the circuit board 24 of FIG. 1 and for connecting it to separate tracks of the circuit board 24 are disposed in the housing bottom 52. The housing cap 53 has an opening 55 with oblique side faces 56, which are intended as stops and will be described below. A cap-shaped actuation button 57 is seated upon the switch housing 51, and it is pressed upward by four restoring springs 58 supported in the switch housing 51. The stroke of the actuation button 57, which is shown at 59 in FIG. 9, is limited at the top by cams 60 (FIGS. 8, 10). A trip cam 61 made of spring wire is disposed in the interior of the actuation button 57 and is held in place by fixation pins 62.

Associated with the trip cam 61 is a switch toggle 63, which has two lateral stop faces 64 corresponding to the side faces 56 of the opening 55 in the housing cap 53 and serving to limit the pivoted positions of the switch toggle 63. The switch toggle 63 also has slideways 65 for the trip cam 61, separated from one another by a protrusion; the slideways 65 are inclined toward one another and terminate in respective indentations. The switch toggle 63 is further provided with a stud 67 acted upon by a spring 66. The rounded end of the stud 67, under the influence of the spring 66, rests on a curved contact toggle 68. The contact toggle 68 is pivotably supported on the middle connection pin 54 protruding inward from the inside of the housing bottom 52. The two outer connection pins 54, which also protrude inward from the inside of the housing bottom 52, serve as fixed contact elements for the contact toggle 68.

It will be udnerstood from the drawing that when the actuation button 57 is pressed, the trip cam 61 moves along one slideway 65 and tends, counter to the force of the spring 66 of the stud 67, to press the switch toggle 63 into its other pivoted position. As shoon as the stud 67 moves past the pivot point of the contact toggle 68 on the middle connection pin 54, it presses the contact toggle 68 into its other switching position. In so doing, the switch toggle 63, under the influence of the spring 66, automatically pivots into this other pivoted position, in which it is held firmly via its respective stop face 64. The contact toggle 68, in turn, is held firmly in its new switching position by the spring-loaded stud 67.

This selective push switch, which in the portable lamp according to FIG. 1 is used as an on/off switch, is distinguished by a particularly low structural height. The switch housing 51 and the cap-shaped actuation button 57 may also be round instead of rectangular in embodiment. In that case it is possible to provide merely a single coaxial restoring spring, instead of four restoring springs 58.

In the portable lamp according to FIG. 1, push switches embodied differently may also be used; for instance, a micro-key switch provided with a resilient actuation device may be used. However, it is always most suitable to provide a diaphragm-like push-in area in the wall of the handle in order to actuate the switch, in order to avoid having actual openings in the wall and to prevent unintentional removal of the handle from the guard tube. The diaphragm may also extend annularly in the circumferential direction of the handle and have a rotating ring which is provided with an inner protrusion or cam. To actuate the push switch disposed underneath the wall of the rotating handle, the rotating ring is moved into the particular rotated position in which its protrusion or cam is located above the push switch.

It is to be understood that the foregoing text and drawings relate to embodiments of the invention given by way of example but not limitation. Various other embodiments and variants are possible within the spirit and scope of the invention.

What is claimed is:

1. A portable lamp including a fluorescent tube and a ballast tube, comprising:

an at least partially transparent guard tube surrounding said fluorescent tube, said guard tube being closed at one end by a cap, and at its other end by a closure element, said other end supporting thereon a handle, said handle and said closure element being adapted to receive therein a power connection cable, said fluorescent tube being supported at each end by a base, one base being located nearer the handle than the other base, said one base supporting a carrier plate having an ignition and feeder circuit arrangement, said carrier plate being electrically connected to connection elements of both ends of said fluorescent tube and to said power connection cable, said carrier plate being releasably mechanically connected at one end with said one base, and at an opposite end with said closure element, said closure element including means for locking it within said guard tube.

2. A portable lamp as defined by claim 1, wherein said one base rests on the inner surface of the guard tube, has a passageway for contact elements of the fluorescent tube on one end thereof facing the handle, and is provided with releasable clamping means for receiving said carrier plate.

3. A portable lamp as defined by claim 2, wherein said clamping means includes a slit, molded with the base, for the carrier plate and releasable retaining means, such as a screw or a detent spring, molded onto the base.

4. A portable lamp as defined by claim 2, characterized in that the contact elements of the fluorescent tube on the end toward the handle are in electrical contact with a conductive surface of the carrier plate.

5. A portable lamp as defined by claim 3, characterized in that the contact elements of the fluorescent tube on the end toward the handle are in electrical contact with a conductive surface of the carrier plate.

6. A portable lamp as defined by claim 1 wherein said closure element rests on the inner surface of the guard tube and includes first releasable clamping means for receiving said carrier plate.

7. A portable lamp as defined by claim 6, wherein said first clamping means includes a slit, molded into the closure element, for the carrier plate and second releasable clamping means.

8. A portable lamp as defined by claim 1, wherein said closure element includes a molded-on detent spring for engaging an opening of the guard tube.

9. A portable lamp as defined by claim 1, wherein said handle and said closure element each have a passageway for the connection cable, the wires of said cable being plug-insertably connected with the carrier plate.

10. A portable lamp as defined by claims 1, wherein said handle has a passageway for the connection cable, said connection cable being connected to fixed contact elements disposed in the handle immediately before the passageway in the handle for the connection cable, and said carrier plate including in the vicinity of the closure element a corresponding number of contact springs which rest on the contact elements of the connection cable.

11. A portable lamp as defined in claim 1, wherein contact pins open at both ends are disposed in the handle, said carrier plate including, in the vicinity of the closure element, a corresponding number of contact springs which rest on one set of ends of the contact pins, and said handle, in the vicinity of opposite ends of the contact springs, is embodied to receive a plug, disposed on the connection cable, having contact bushes for the contact pins.

12. A portable lamp as defined by claim 1, said other base rests on the inner surface of the guard tube and includes a passageway for the contact elements of the fluorescent tube on the end toward the cap, said other base including a contact lamina in mechanical contact with the contact elements and in electrical contact with the carrier plate via a conductor extending along the guard tube.

13. A portable lamp as defined by claim 1, wherein said carrier plate includes a push switch having an actuation device which terminates in an opening of the guard tube directly at the inner surface of a wall of the handle, said handle wall being jacket-like and including diaphragm means whereby said push switch is actuated by exerting an external pressure upon the diaphragm means.

* * * * *